US006694559B1

(12) United States Patent
Sloan et al.

(10) Patent No.: US 6,694,559 B1
(45) Date of Patent: Feb. 24, 2004

(54) TOILET BRUSH

(75) Inventors: Alina Kaye Sloan, Port Melbourne (AU); Barry William Crone, Balwyn (AU); Dean Lynton Holmes, Eaglemont (AU); Jan-Anders Schjottelvig, Briar Hill (AU)

(73) Assignee: E. D. Oates Pty Ltd., Reservoir (AU)

( * ) Notice: Subject to any disclaimer, the term of this patent is extended or adjusted under 35 U.S.C. 154(b) by 0 days.

(21) Appl. No.: 09/763,262

(22) PCT Filed: Aug. 18, 1999

(86) PCT No.: PCT/AU99/00667

§ 371 (c)(1),
(2), (4) Date: Feb. 20, 2001

(87) PCT Pub. No.: WO00/10422

PCT Pub. Date: Mar. 2, 2000

(30) Foreign Application Priority Data

Aug. 20, 1998 (AU) ..... PP 5363

(51) Int. Cl.[7] ..... A47K 11/10; A46B 3/04
(52) U.S. Cl. ..... 15/106; 15/160; 15/188
(58) Field of Search ..... 4/255.05, 255.11; 15/106, 110, 160, 164, 187, 188, 210.1; 206/361, 362.2, 362.3, 209, 209.1; 248/110; 312/206, 207; D6/551

(56) References Cited

U.S. PATENT DOCUMENTS

| | | | | | |
|---|---|---|---|---|---|
| 1,660,318 | A | * | 2/1928 | Anderson | 15/164 |
| 4,033,650 | A | | 7/1977 | Alissandratos | |
| 4,700,423 | A | * | 10/1987 | Zuliani | 15/160 |
| 5,440,775 | A | * | 8/1995 | Banks | 15/106 |
| 5,727,280 | A | | 3/1998 | Romano | |

FOREIGN PATENT DOCUMENTS

| | | | |
|---|---|---|---|
| AU | 47970/59 | A | 10/1960 |
| AU | 47904/90 | A | 8/1990 |
| DE | 708735 | * | 7/1941 |
| DE | 29706851 | U1 | 10/1997 |
| EP | 0 329 938 | * | 8/1989 |

* cited by examiner

*Primary Examiner*—Terrence R. Till
(74) *Attorney, Agent, or Firm*—Michael Best & Friedrich LLP; Grady J. Frenchick; Jeffrey D. Peterson

(57) ABSTRACT

A toilet brush having a frame member (1), a handle portion (3) and a brush portion (5). The brush portion includes front bristles (13) for cleaning a toilet bowl and rearwardly extending bristles (15) for cleaning the lip of a toilet. The bristles and a soft covering (19) of the handle have been moulded onto the frame member using a soft rubbery plastics composition.

13 Claims, 4 Drawing Sheets

TOILET BRUSH

FIELD OF THE INVENTION

The present invention relates to a toilet brush. In a particular form it relates to a toilet brush provided with cleaning portions extending in different directions. In a further particular non-limiting aspect it relates to a toilet brush and a housing therefore.

BACKGROUND OF THE INVENTION

Toilet brushes typically are provided with a handle and a brush end. The brush end may be provided with a number of holes which are used to locate and attach a number of bristles which form the brush. The bristles all point in one direction usually at about 60° to 90° to the direction of the handle end of the brush. With a brush construction of this type, it is generally easy to brush a toilet bowl with the angle of the brush head making it easy to cope with the changing angles of the bowl. However, many toilet bowl constructions include an upper step or lip which is substantially at right angles to the bowl. As this portion of the toilet can be subject to soiling, it is important that the brush be constructed in such a way that in can easily reach the underneath of the lip whilst at the same time being able to clean the bowl part of the toilet.

Unfortunately, as the conventional brushes have their bristles angled so that they may readily clean the bowl part of the toilet, they are very poorly designed in relation to the cleaning of the aforesaid lip portion which is at right angles thereto. Furthermore, because such brushes are typically constructed by attaching a number of bristles in locating holes, the step of assembling the bristles to form the brush, because it represents an additional step in the manufacturing process, can lead to an increase in the overall cost of the brush.

Thus there is a need for a brush which can readily clean both the toilet bowl of a toilet and the over hanging lip portion of the toilet bowl. In addition, there is a need for a brush which can be manufactured without assembling bristles to form a brush.

DISCLOSURE OF THE INVENTION

The invention provides a toilet brush including,

- a frame member having a brush end, a handle end and an intermediate portion joining the brush end and handle end,
- a primary cleaning portion including bristles extending from the brush end, and
- a secondary cleaning portion extending rearwardly from the brush end.

Suitably the intermediate portion extends generally at an angle to the brush end.

The secondary cleaning portion may thus extend generally in line with and/or parallel to the brush end.

The frame member may be moulded. It may be formed of a polymeric material. The frame member may have a Shore hardness (as measured in the A scale) in excess of 70.

Suitably the polymeric material includes polypropylene or a copolymer of polystyrene and polypropylene. It may include a filler. Preferably the filler may comprise 100% to 40% by weight of the polymeric material, more preferably 15% to 25% by weight. Talc is a suitable filler. The polymeric material may include a fibrous reinforcement. The fibrous reinforcement may include glass fibre. The fibrous reinforcement suitably comprises 10% to 20% by weight of the polymeric material.

The secondary cleaning portion may include bristles. The bristles on the primary cleaning portion suitably extend at an angle to the bristles on the secondary cleaning portion. The angle may be between 70° and 120°.

The bristles may be moulded. They may be formed of a bristle composition incorporating a polymeric material. The bristle composition may include one or more fillers and/or reinforcement materials. Preferably the bristle composition will include a proportion of rubber material. It may also include a proportion of plastics material.

The bristles may be moulded on to the frame. They may be formed of a softer material than the frame member. The bristles may have a shore H hardness of 35 to 85, more preferably 50 to 75 and most preferably 60 to 70.

The polymeric materials forming the frame member and bristles may be chosen such that they bond or fuse together during moulding. The polymeric materials may be Santoprene for the bristles and polypropylene for the frame member. They may include anti-bacterial additives.

Attachment means may be provided on the frame to facilitate attachment of the bristles thereto. The attachment means may include profile features on the frame. Preferably the profile features include one or more ribs, grooves, recesses or raised portions.

A step may be provided on the upper surface of the brush end of the frame member. Suitably the step may be undercut. The material forming the bristles may extend to cover the region of the frame member bounded by the step.

Similarly the handle end of the frame member may be covered with a covering material which is different to the material forming the frame member. The covering material may be moulded on to the frame member to form an integral handle. The covering material may be formed of the same material as the material forming the bristles. It may be moulded on to the frame member at the same time as the bristles are moulded thereonto.

The handle end may be formed with a step. Suitably the step extends partially around the handle end on the upper surface thereof. The step may be undercut. The covering material may extend to cover the region of the upper surface of the handle bounded by the step.

The underneath of the handle end may also be covered by the covering material. The underneath of the handle end may also be provided with attachment means similar to those described hereinbefore to facilitate binding of the covering material to the handle.

Suspension means are suitably provided on the intermediate portion of the frame member. The suspension means may include an intermediate stepped portion. The intermediate stepped portion may be constructed so that the brush may be hung from a brush housing.

The brush housing may include a floor, walls, roof and an opening for receiving the brush. The roof may include a recess. The recess may be generally C-shaped. It may be provided so that the edges thereof may support the intermediate stepped portion when the brush is hung in the housing.

Location of the intermediate stepped portion on the brush may be arranged so that the bristle end of the brush hangs within the housing when the stepped portion is supported by the edges of the recess.

The invention will now be described with reference to the accompanying drawings.

DETAILED DESCRIPTION OF THE PREFERRED EMBODIMENT

Figure 1:
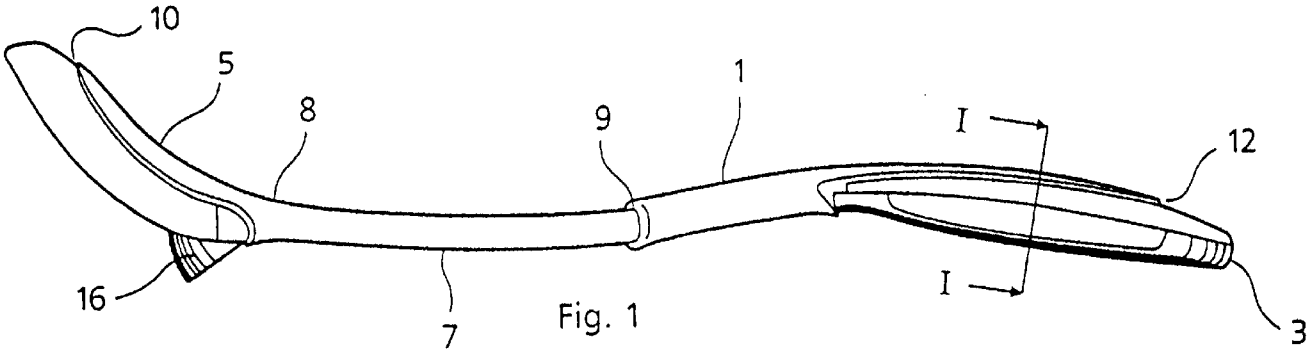
FIG. 1 is a side elevation of a frame member used for constructing a toilet brush in accordance with the present invention.
Figure 2:
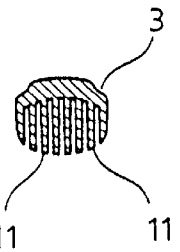
FIG. 2 is a view of the section I—I taken through FIG. 1.
Figure 3:
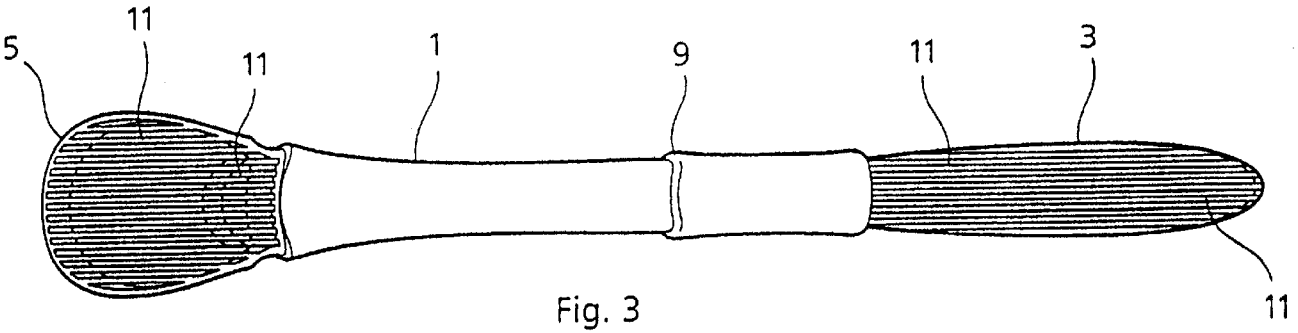
FIG. 3 is a plan view of the underneath of the frame member of FIG. 1.

Referring to FIGS. 1 to 3, there is shown a frame member 1 which may typically be moulded of a hard thermoplastic material using conventional moulding techniques such as injection moulding. For example, it may be moulded from polypropylene and it may contain a proportion of an additive or filler such as talc to modify its properties such as hardness. It may typically contain about 20% by weight of talc.

The frame member includes a handle portion 3 at one end and a brush portion 5 at the other end, the two being joined by an intermediate portion 7. A bend 8 which provides that the brush portion is at an angle to the intermediate portion and handle portion is provided along the brush portion and at the join with the intermediate portion.

The intermediate portion is of lesser thickness nearer the handle portion but steps via the step 9 to a region of increased thickness closer to the handle portion. The step 9 is located along the intermediate portion. It is positioned such that it forms a balance point for the completed brush about which the brush may be hung in the brush housing 50 to be described later.

Both the underneath of the handle portion and the brush portion are provided with ribs 11 which serve to facilitate the attachment of soft rubbery material to the frame member to form the completed brush.

Figure 4:
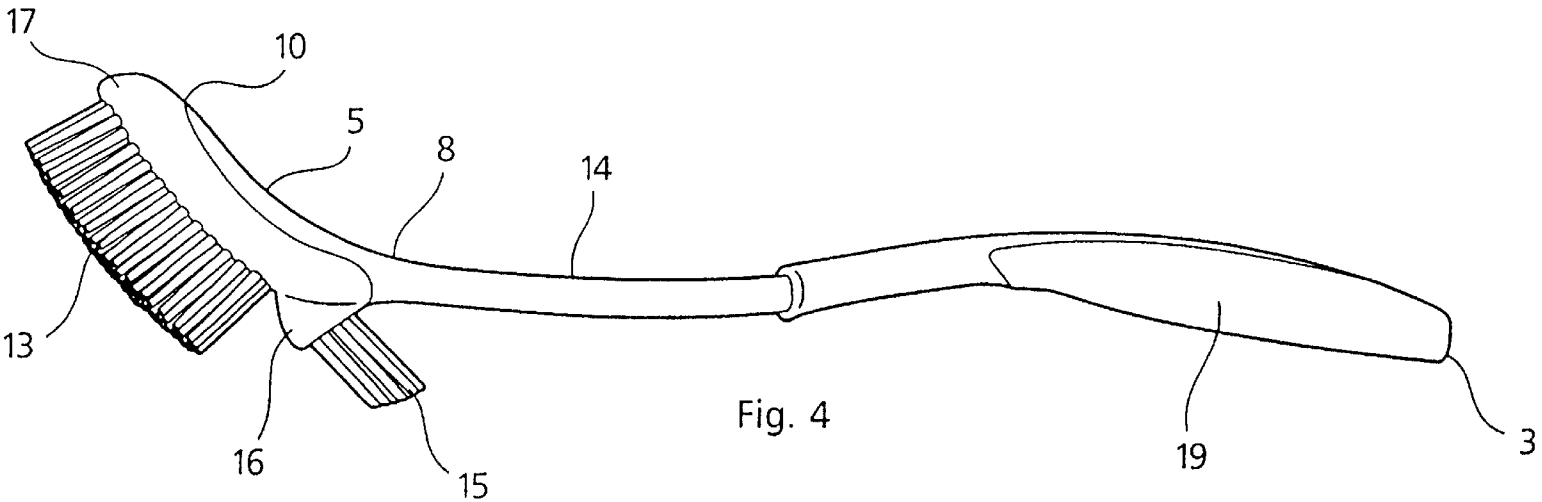
FIG. 4 is a side elevation of a brush constructed in accordance with the invention.
Figure 5:
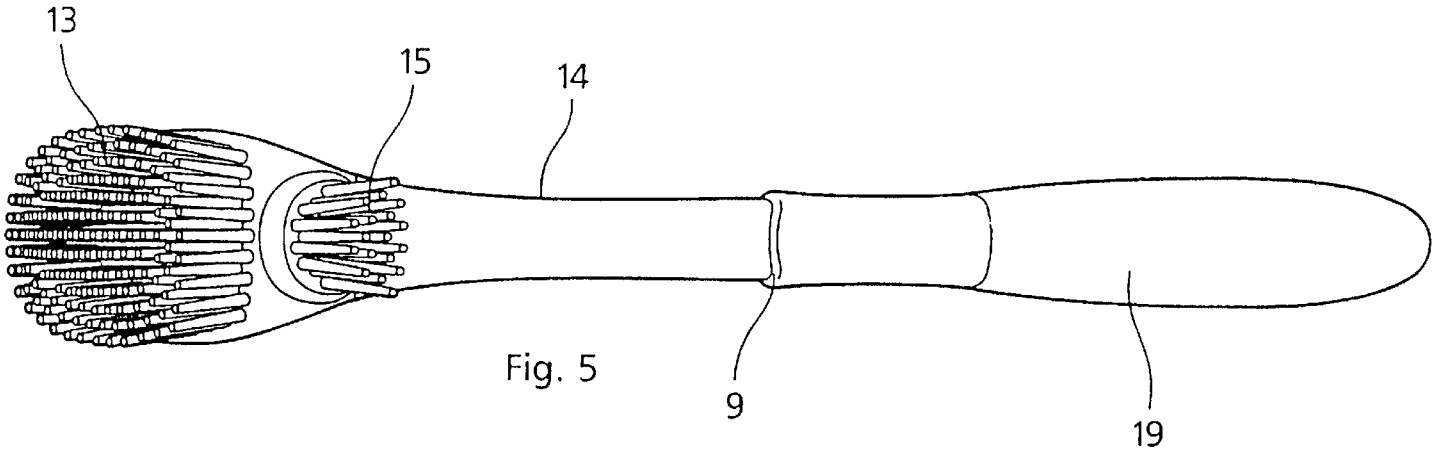
FIG. 5 is an underneath view of a brush constructed in accordance with the invention.
Figure 6:
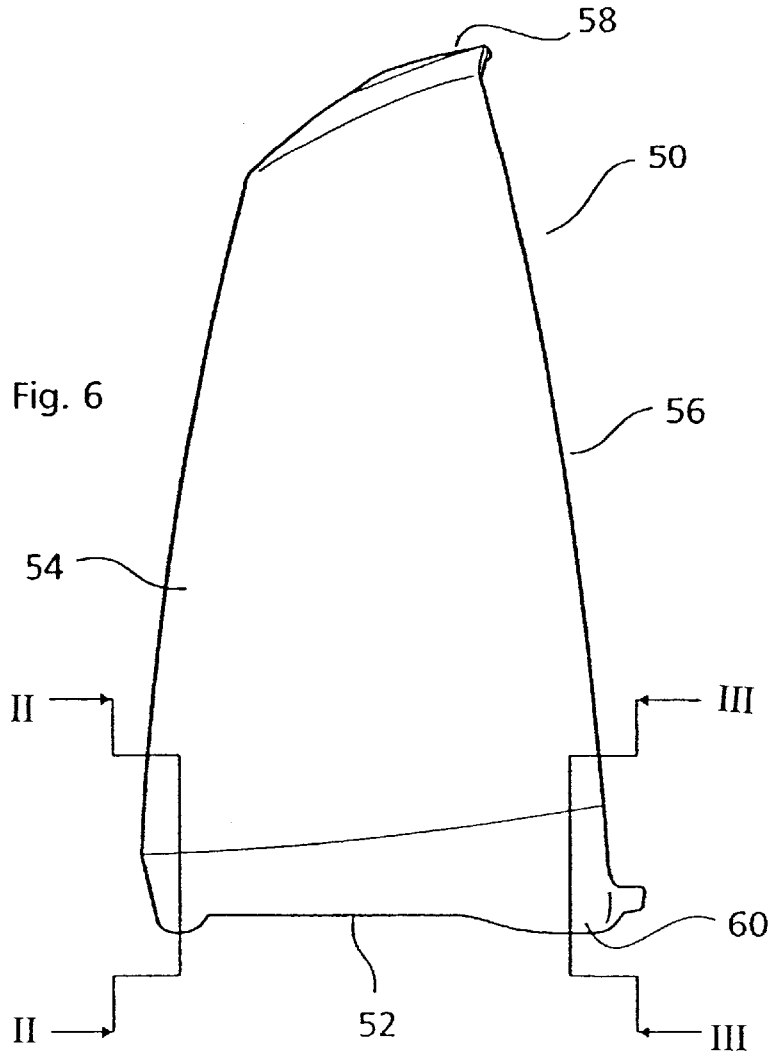
FIG. 6 is a side on elevation view of a brush housing.
Figure 7:
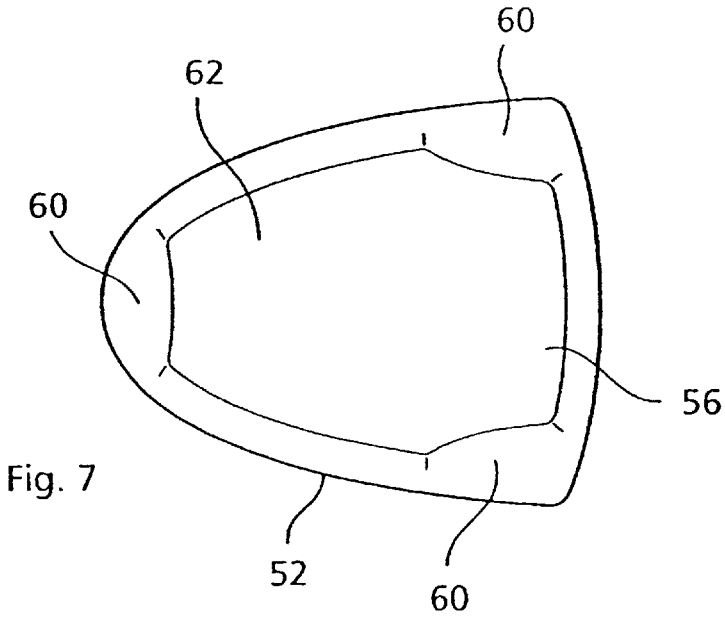
FIG. 7 is a plan view of the top of the housing of FIG. 6.
Figure 8:
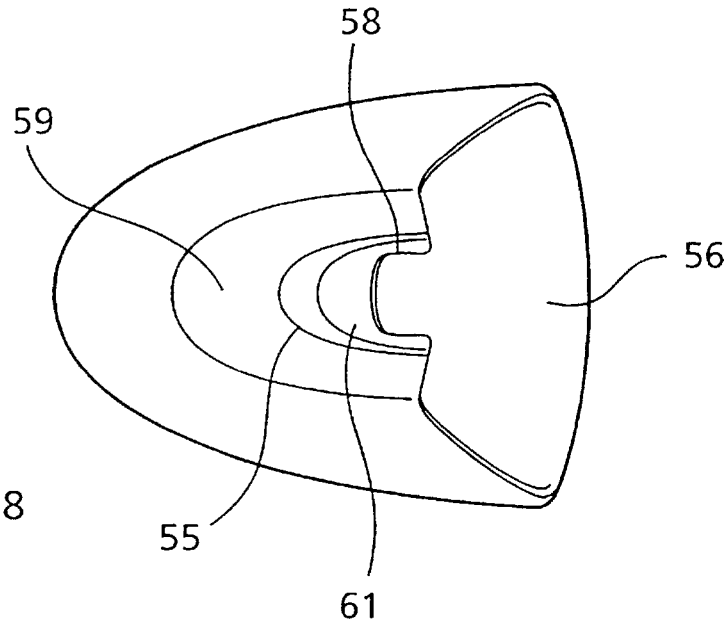
FIG. 8 is a plan view of the base of the brush housing of FIG. 6.
Figure 9:
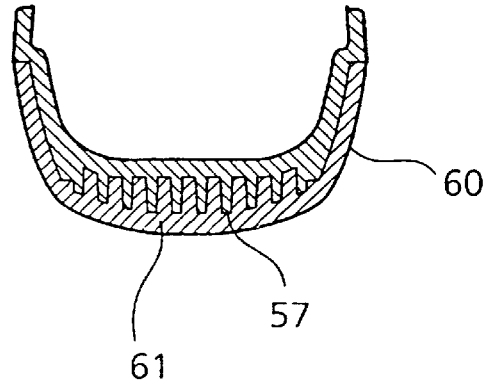
FIG. 9 is a view of the section III—III of FIG. 6.
Figure 10:
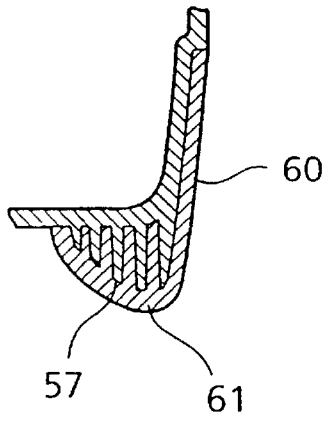
FIG. 10 is a view of section II—II of FIG. 6.

Referring to FIGS. 4 and 5, there is shown a completed brush 14 which incorporates the frame member 1 shown in relation to FIGS. 1 to 3. Generally speaking it is anticipated that the completed brush will be formed in the same moulding machinery as the frame member, with the material forming the front bristles 13, rear bristles 15 and soft covering 17 and 19 being injection moulded onto the frame member after the initial moulding process for the frame member has been completed. The second step for the integral moulding of softer material call be carried out with any suitable thermoplastic polymer which is relatively soft at room temperature. It is particularly preferred that it be a combination of rubber and plastic material having a SHORE A hardness of 50 to 75.

The ribs 11 on the frame member serve to facilitate the attachment between the soft moulding material forming the bristles and handle covering and the hard polymeric material forming the frame member. Furthermore, the undercut stepped portions 10 and 12 define the regions about the upper surfaces of the handle portion and brush portions which will be covered by the softer covering material.

It can be seen that the front bristles 13 which form a primary cleaning portion of the brush are approximately at right angles to the bristles 15 which form a secondary cleaning portion. The bristles 15 extend rearwardly and generally in line with the brush end, from a step 16 in the brush end at the region of bend between the brush and the intermediate portion thereby extending clear from and at an angle to the intermediate portion.

The front bristles because of their angle with respect to the handle 19 are particularly suitable for cleaning the bowl of a toilet which is at a generally complementary angle whereas the rear bristles 15 are particularly adapted to clean the underside of the circumferential lip of a toilet bowl.

The fact that the brush can be made in a two stage injection moulding process as an integral unit means that no assembly is required and the brush can even be provided with a soft comfortable handle in the same operation.

Referring to FIG. 6 to FIG. 10, there is shown a brush housing which may similarly be moulded in a two stage injection moulding process from both harder and softer plastics.

The brush housing includes a base 52 with side walls 54 extending three quarters of the way around the base leaving an opening 56. These side walls are inclined towards each other to form the roof 59 which is provided with a C-shaped recess 58 for receiving the brush.

A floor 62 is provided at the bottom of the brush housing as part of the base, and three feet 60 are provided to support the floor.

The feet include a series of ribs 57 which are covered by the soft covering 61 applied in the second injection moulding stage, the ribs acting to secure the soft covering firmly to the harder material forming the bulk of the brush housing.

A small amount of soft covering 61 is also applied around the recess 58, in the region bounded by the step 55 surrounding the recess for enhancing appearance and providing a region of higher surface friction properties than the harder material of the housing to hold the brush. It is noted that soft rubbery plastics often provide greater surface friction than hard plastics.

When the brush 14 is hung in the housing, the step 9 snugly sits on top of the sides of the recess 58. The weighting of the brush is such that the brush portion dangles in such a way that the front end of the brush aligns above the floor 62 whether the brush is inserted into the recess forwards or backwards. This has the advantage that any drips running from the brush should drop directly onto the floor 62 without splashing outside the housing. Furthermore, the construction is such that cavities are avoided with a consequent reduction of build up of slime and bacteria compared to conventionally constructed toilet brushes.

While it has been convenient to describe the invention herein in relation to particularly preferred embodiments, it is to be appreciated that other constructions and arrangements are considered as falling within the scope of the invention. Various modifications, alterations, variations and/or additions to the constructions and arrangements described herein are also considered as falling within the scope and ambit of the present invention.

What is claimed is:

1. A toilet brush including, a frame member having a brush end, a handle end and an intermediate portion joining the brush end and handle end, a primary cleaning portion including bristles extending from the brush end, wherein the bristles have a shore A hardness of 35 to 85 and are formed of a softer material than the frame member, and a secondary cleaning portion extending rearwardly from the brush end, wherein the secondary cleaning portion includes bristles which extend at an angle between 70° and 120° to the bristles on the primary cleaning portion and at an angle to the intermediate portion, wherein the intermediate portion extends generally at an angle to the brush end and the secondary cleaning portion extends generally in line with and/or parallel to the brush end.

2. The toilet brush according to claim 1, wherein the frame member and bristles polymeric materials which bond or fuse together when the bristles are molded onto the frame member.

3. The toilet brush according to claim 1, wherein the handle end has a cover formed from a material having the same composition as the bristle forming composition.

4. A toilet brush according to claim 3 wherein the handle end includes profile features for facilitating attachment of the cover thereto.

5. A toilet brush according to claim 4 wherein the profile features include one or more of the following group: ribs, grooves, recesses, raised portions, or an undercut step.

6. A toilet brush including, a frame member having a brush end, a handle end and an intermediate portion joining the brush end and handle end, a primary cleaning portion including bristles molded from a polymeric material, the bristles extending from the brush end, and a secondary cleaning portion extending rearwardly from the brush end, wherein the secondary cleaning portion includes bristles which extend at an angle between 70° and 120° to the bristles on the primary cleaning portion and at an angle to the intermediate portion, wherein the intermediate portion extends generally at an angle to the brush end and the secondary cleaning portion extends generally in line with and/or parallel to the brush end, and wherein the frame includes profile features which facilitate attachment of bristles to the frame.

7. A toilet brush according to claim 6 wherein the profile features include a step which is undercut and the material forming the bristles extends to cover the region of the frame member bounded by the step.

8. A toilet brush according to claim 6 wherein the profile features include any one or more of the following group: ribs, grooves, recesses, or raised portions.

9. A toilet brush including, a frame member having a brush end, a handle end and an intermediate portion joining the brush end and handle end, a primary cleaning portion including bristles, extending from the brush end, and a secondary cleaning portion extending rearwardly from the brush end, wherein the secondary cleaning portion includes bristles which extend at an angle between 70° and 120° to the bristles on the primary cleaning portion and at an angle to the intermediate portion, wherein a step is provided on the intermediate portion.

10. A toilet brush including, a frame member having a brush end, a handle end and an intermediate portion joining the brush end and handle end, a primary cleaning portion including bristles molded from a bristle forming composition, wherein the bristle forming composition is a polymeric material, the bristles extending from the brush end, and a secondary cleaning portion extending rearwardly from the brush end, wherein the secondary cleaning portion includes bristles which extend at an angle between 70° and 120° to the bristles on the primary cleaning portion and at an angle to the intermediate portion, wherein the intermediate portion extends generally at an angle to the brush end and the secondary cleaning portion extends generally in line with and/or parallel to the brush end, wherein the polymeric material includes rubbery material and anti-bacterial additives.

11. A toilet brush housing for use in association with a toilet brush, the toilet brush including a frame member having a brush end, a handle end and an intermediate portion joining the brush end and handle end, a primary cleaning portion including bristles molded from a polymeric material, the bristles extending from the brush end, and a secondary cleaning portion extending rearwardly from the brush end, wherein the secondary cleaning portion includes bristles which extend at an angle between 70° and 120° to the bristles on the primary cleaning portion and at an angle to the intermediate portion, wherein the toilet brush housing includes a floor, walls, roof, an opening for receiving the brush and a recess in the roof, the recess being shaped so that its edges receive and support the intermediate portion of the toilet brush by supporting a stepped portion provided on the intermediate portion, the toilet brush housing having, three legs, the legs including ribbed portions integrally formed with the floor of the toilet brush housing to project downwardly therefrom, the ribbed portions being covered with soft rubbery plastics.

12. A toilet brush housing according to claim 11, wherein the edges around the recess are covered with soft rubbery plastics.

13. A combination toilet brush and housing, the toilet brush including a frame member having a brush end, a handle end and an intermediate portion joining the brush end and handle end, a primary cleaning portion including bristles molded from a polymeric material, the bristles extending from the brush end, and a secondary cleaning portion extending rearwardly from the brush end, wherein the secondary cleaning portion includes bristles which extend at an angle between 70° and 120° to the bristles on the primary cleaning portion and at an angle to the intermediate portion;

the toilet brush housing including a floor, walls, roof, an opening for receiving the brush and a recess in the roof, the recess being shaped so that its edges receive and support the intermediate portion of the toilet brush by supporting a stepped portion provided on the intermediate portion, the toilet brush housing having, three legs, the legs including ribbed portions integrally formed with the floor of the toilet brush housing to project downwardly therefrom, the ribbed portions being covered with soft rubbery plastics.

* * * * *